US006192574B1

(12) United States Patent
Wargren

(10) Patent No.: US 6,192,574 B1
(45) Date of Patent: Feb. 27, 2001

(54) METHOD OF MANUFACTURING AND ATTACHING A COIL TO AN ELECTRIC CIRCUIT USING A CIRCUIT FIXTURE

(75) Inventor: Bengt Wargren, Stockholm (SE)

(73) Assignee: Metget AB, Ronneby (SE)

( * ) Notice: Subject to any disclaimer, the term of this patent is extended or adjusted under 35 U.S.C. 154(b) by 0 days.

(21) Appl. No.: 09/284,985

(22) PCT Filed: Nov. 11, 1996

(86) PCT No.: PCT/SE96/01447

§ 371 Date: May 11, 1999

§ 102(e) Date: May 11, 1999

(87) PCT Pub. No.: WO98/21730

PCT Pub. Date: May 22, 1998

(51) Int. Cl.[7] ..... H01F 7/06

(52) U.S. Cl. ..... 29/605; 29/854; 29/825; 29/743; 29/592.1; 294/64.1

(58) Field of Search ..... 29/854, 825, 33 F, 29/743, 745, 729, 592.1, 33 K, 33 M, 605, 840; 294/64.1

(56) References Cited

U.S. PATENT DOCUMENTS 3,641,648 * 2/1972 Kalberman ..... 29/203 B
4,712,784 * 12/1987 Carrell ..... 271/108
4,785,527 * 11/1988 Bernard et al. ..... 29/605
4,860,433 * 8/1989 Miura ..... 29/605
5,118,153 * 6/1992 Allison et al. ..... 294/64.1
5,634,261 * 6/1997 Gustafson ..... 29/609
5,926,944 * 7/1999 Smith et al. ..... 29/602.1

FOREIGN PATENT DOCUMENTS

8503166 * 6/1987 (NL) .
93/09551 5/1993 (WO) .

* cited by examiner

*Primary Examiner*—Lee Young
*Assistant Examiner*—Minh Trinh
(74) *Attorney, Agent, or Firm*—Jacobson, Price, Holman & Stern, PLLC

(57) ABSTRACT

A method of manufacturing a coil and attaching the coil to contact points of an electric circuit. One end of a winding filament is brought in a stretched state to a first position in a winding machine, the filament is wound to provide a coil, and the filament after the finished coil is stretched to a second position and cut. The first and second positions are located inwardly of the coil. A circuit fixture carrying an electric circuit at a third position, which corresponds to the first and second positions inwardly of the coil, is caused to collect the wound coil, and the filament ends are welded together at the contact points on the electric circuit. The ends of the winding filament are held firmly at the first and second positions, respectively, by means of a hole with subpressure in the winding machine, and at the third position by means of a hole with subpressure in the circuit fixture.

2 Claims, 1 Drawing Sheet

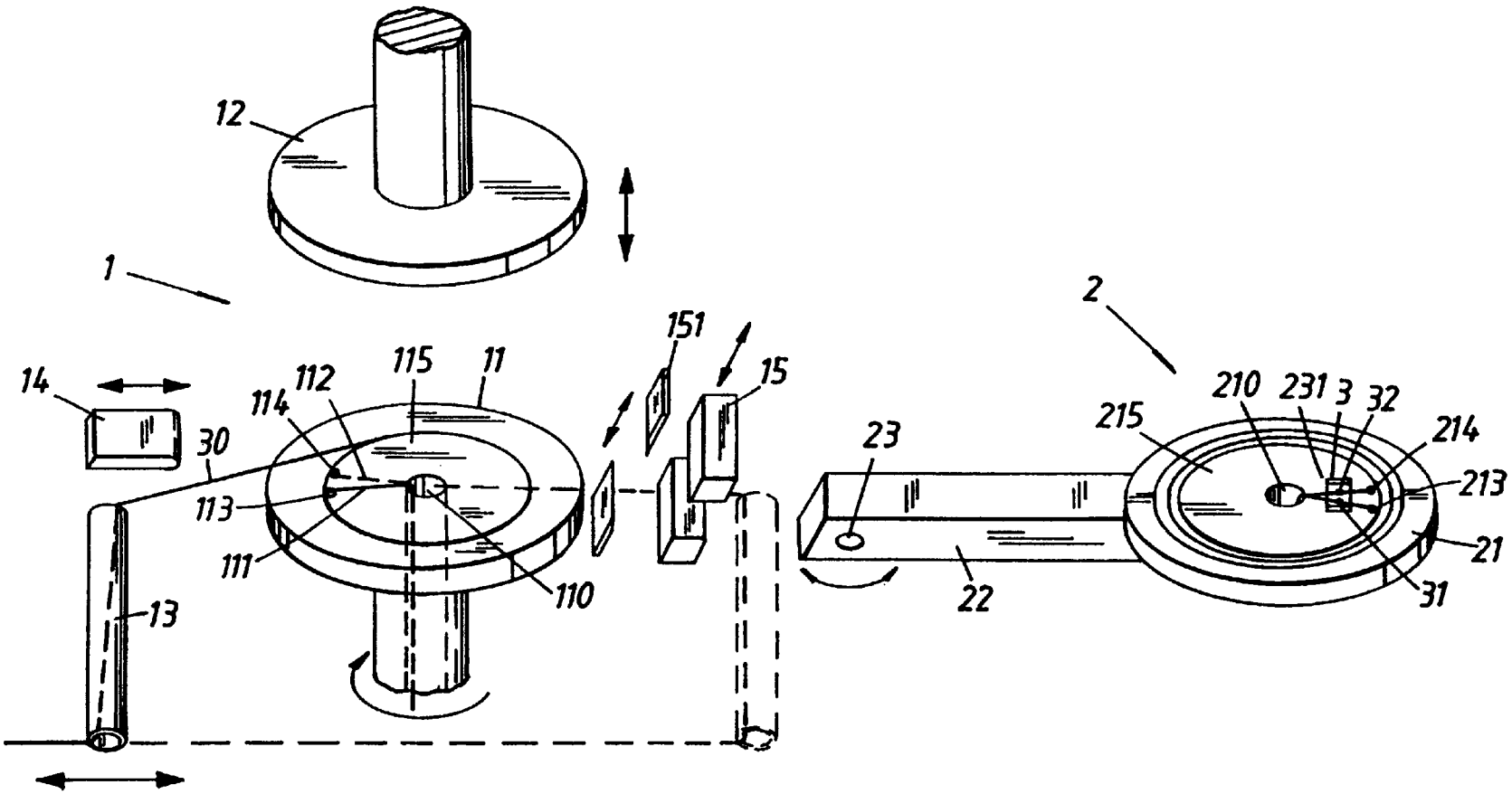
2
215
210
231
3
32
214
213
21
31
22
23
15
151
110
11
115
112
114
113
111
12
30
1
14
13

METHOD OF MANUFACTURING AND ATTACHING A COIL TO AN ELECTRIC CIRCUIT USING A CIRCUIT FIXTURE

FIELD OF INVENTION

The present invention relates to a method of manufacturing a coil and attaching the thus manufactured coil to the contact points of an electric circuit. The invention also relates to apparatus for carrying out the method.

More specifically, the invention relates to the manufacture of electric components of very small dimensions, and in particular components that include a coil which is connected to one or more electronic circuits or to one or more chips or integrated circuits, printed circuits or like electronic elements. Reference to electric circuits in the following will be understood to include one or more kinds of the aforesaid elements on each mentioning occasion.

DESCRIPTION OF THE BACKGROUND ART

Certain problems arise in the manufacture of components of the aforedescribed nature. These problems are essentially caused by the very small dimensions of the elements concerned and require manufacturing precision. Typical dimensions of electronic circuits of the kind in question are in the order of 0.9×0.9×0.4 mm and such a circuit will typically weigh 4 mg. The copper filament used in winding the coil has a typical diameter of 0.03 mm including insulation.

In manufacturing such a component, it has earlier been necessary to pre-attach, e.g., a chip to a tool and then wind a coil with the aid of a so-called flyer with one end of the copper filament affixed to a contact point on the chip, and thereafter affix the other end of the copper filament across the next contact point and therewith establish contact across the whole of the circuit, upon completion of the coil winding process. One such method of procedure is described in European Patent Specification 0573469.

A coil that has been manufactured in this traditional manner will have a very non-uniform quality, because the filament, or wire, is taken from an external source and placed adjacent the bobbin centre, which initially has a given shape (thickness), and is wound initially from within and outwards. Consequently, fewer layers of copper filament are obtained where the first end of the filament has passed in towards the centre of the coil and winding has commenced. As a result, the coil will be wider in this region in order to obtain the same number of turns. The corresponding side of the coil then receives more layers and will thus be thicker.

An object of the present invention is to make possible the manufacture of a coil of greater and more uniform quality, by coiling the filament instead of winding the filament with the aid of a flyer, whereby the electronic circuit or circuits is/are kept outside the actual coiling procedure. This more uniform quality is achieved by placing the filament in the centre from the very beginning and then coiling the filament outwards in the tool.

Another object of the invention is to place the chip, etc., in the coil centre hole directly, thereby avoiding the need to fold-in the chip manually.

A further object of the invention is to enable copper filament and chip to be held in place with the aid of sub-pressure, which has been found to be a much simpler and much cheaper solution than the mechanical holders that are otherwise usual.

SUMMARY OF THE INVENTION

A method of manufacturing a coil and attaching the manufactured coil to the contact points of an electric circuit, wherein one end of a winding filament is brought in a stretched state to a predetermined first position in a winding machine; wherein the winding filament is wound to form a coil in the winding machine while maintaining said filament end at said first position inwardly of the coil; wherein the end of the winding filament after the coil is brought in a stretched state to a predetermined second position in the winding machine, also inwardly of the coil, and the filament then cut; wherein a circuit fixture or jig coacting with the winding machine and having an electric circuit inlaid in a predetermined third position that corresponds to said first and said second positions in the winding machine is brought into contact with the winding machine to collect the wound coil; and wherein the filament ends of the coil are finally welded together with the contact points on the electric circuit located inwardly of the coil.

These and other characteristic features of the inventive method and the inventive apparatus for carrying out the method will be evident as set forth herein.

DETAILED DESCRIPTION OF THE INVENTION

Apparatus Description

The invention will now be described in more detail with reference to the accompanying drawing which illustrates schematically apparatus for carrying out the inventive method.

The apparatus includes a winding machine 1 and a circuit fixture or jig 2 which coacts with the winding machine.

The winding machine 1 includes a rotatable bobbin plate 11 which has in the centre thereof a hole 110 for firmly holding filament ends by means of subpressure, and also has a slightly raised centre part 115 (about 0.15–0.35 mm). Provided on the periphery of this centre part, to the left in the drawing, are a first pin 113 and a second pin 114 which lie relatively close to one another and which are intended as supports for the filament ends. The machine also includes a movably arranged bobbin lid 12 which can be moved towards and away from the bobbin plate 11 and which has holes (not shown) corresponding to the pins 113, 114, a filament guiding means 13 for guiding the filament 30 during winding of a coil, and filament guide 14 for locking the outer filament end of a wound coil to the bobbin plate 11, whereas the filament guiding means 13 guides the filament transversely across the centre hole 110 to a filament holder 15 having filament cutting means 151. The bobbin plate 11 has a first position 111 and a second position 112 to which one end of the winding filament is brought in a stretched state prior to winding the coil, and to which the terminal end of the coil is brought in a stretched state subsequent to winding the coil. A small recess (groove) is provided in the plate at said two positions, between the periphery and the centre, for receiving respective filament ends.

The circuit fixture or jig 2 has a bottom plate 21 which corresponds to the bobbin plate 11 and which has a hole 210 in the centre of the plate for firmly holding filament ends with the aid of subpressure, corresponding to the hole 110 in the bobbin plate, and also has a pre-selected third position 231 for firmly holding electric circuit 3 with the contact points 31, 32, said third position corresponding to said first and said second positions on the bobbin plate 11. The plate has a slightly raised centre part 215, in whose periphery there is provided a third pin 213 and a fourth pin 214 which are seated relatively close together and placed so as to take over the function of the pins 113, 114 as filament end support means. The positions of these filament ends will herewith be changed slightly, although not sufficient to risk the filament ends releasing their direct contact with the contact points of the electric circuit. The bottom plate 21 is mounted on a rotatable arm 22, which rotates about an axis 23. The arm can be rotated through 180° in relation to the plate 11, such as to collect a finished coil (with subpressure). The ends of the coil will herewith automatically be brought into abutment with the contact points on the electric circuit, so that the coil ends and contact points can be welded together.

Method Description

1. The bobbin lid 12 is open and the filament 30 is stretched over the hole 110 through the medium of the first pin 113, and is held by the filament holder 15.

2. The filament holder 15 is opened and the filament end is drawn down into the hole 110 by suction and the bobbin lid 12 closed.

3. Coil winding is commenced with the filament end fixed in the hole 110 and stretched over said first position 111.

4. Subsequent to having wound the coil, the bobbin lid 12 is opened and the filament guide 14 enters and locks the filament end firmly in the outer turns of the coil.

5. The filament guiding means 13 moves to the filament holder 15 with the filament which is herewith stretched over the hole 110 through the medium of the second pin 114, whereafter the filament cutting means 151 cuts off the filament, which is then sucked down into the hole 110.

6. The filament guide 14 moves to one side and the coil is ready.

7. The circuit fixture or jig 2 with the inlaid electric circuit 3 is rotated counter clockwise through 180° and collects the finished coil, wherein filament fixation is effected by means of subpressure in the hole 210. The coil and the electric circuit are also fixated with the aid of subpressure

What is claimed is:

1. A method of manufacturing a coil using a winding machine and attaching the coil to contact points of an electric circuit using a circuit fixture, comprising:

bringing a first end of a winding filament in a stretched state to a predetermined first position located inwardly of the coil;

temporarily anchoring the first end of the winding filament in a vacuum hole in the winding machine through suction;

winding said coil with the winding filament to create a finished coil while keeping the first end at said first position;

bringing the winding filament in a stretched state to a predetermined second position located inwardly of the coil and separate from said first position;

cutting the winding filament to create a second end;

temporarily anchoring said second end in the vacuum hole in the winding machine through suction;

contacting the circuit fixture with the winding machine, with the electric circuit on the circuit fixture positioned at a predetermined third position corresponding to the first and second positions in the winding machine to collect the finished coil;

drawing the first end and the second end of the winding filament by suction into a vacuum hole in the circuit fixture such that, as the circuit fixture collects the finished coil, the first and second ends of the winding filament remain in the stretched state in positions corresponding to the first position and the second position, respectively, and portions of said first and second ends are in contact with the contact points on the electric circuit located at the third position;

welding the portions of said first and second ends that are in contact with said contact points to said contact points.

2. The method as set forth in claim 1, wherein the winding filament is thin wire with a diameter of approximately 0.03 mm.

* * * * *